US011553809B2

(12) United States Patent
Hsu

(10) Patent No.: US 11,553,809 B2
(45) Date of Patent: Jan. 17, 2023

(54) ILLUMINATED BEVERAGE CONTAINER

(71) Applicant: Lorraine Melody Hsu, Santa Ana, CA (US)

(72) Inventor: Lorraine Melody Hsu, Santa Ana, CA (US)

( * ) Notice: Subject to any disclaimer, the term of this patent is extended or adjusted under 35 U.S.C. 154(b) by 0 days.

(21) Appl. No.: 17/149,201

(22) Filed: Jan. 14, 2021

(65) Prior Publication Data

US 2022/0218131 A1 Jul. 14, 2022

(51) Int. Cl.

| | |
|---|---|
| ***A47G 19/22*** | (2006.01) |
| ***F21V 23/04*** | (2006.01) |
| ***F21V 5/00*** | (2018.01) |
| ***F21V 33/00*** | (2006.01) |
| ***B65D 13/02*** | (2006.01) |
| ***F21V 5/02*** | (2006.01) |
| ***F21Y 115/10*** | (2016.01) |

(52) U.S. Cl.

CPC ..... *A47G 19/2227* (2013.01); *A47G 19/2272* (2013.01); *B65D 13/02* (2013.01); *F21V 5/005* (2013.01); *F21V 5/02* (2013.01); *F21V 23/04* (2013.01); *F21V 33/0036* (2013.01); *A47G 2019/2238* (2013.01); *F21Y 2115/10* (2016.08)

(58) Field of Classification Search

CPC ..... A47G 19/2272; A47G 19/2227; A47G 2019/2238; A47G 23/02; A47G 23/0309; A47G 23/0306; A47G 23/0208; A47G 23/0216; A47G 23/0241; B65D 13/02; B65D 11/04; B65D 17/02; F21Y 2115/10; F21V 33/0036; F21V 5/005; F21V 5/02; F21V 23/04

See application file for complete search history.

(56) References Cited

U.S. PATENT DOCUMENTS

| | | | | |
|---|---|---|---|---|
| 3,735,113 | A * | 5/1973 | Stott | A47G 19/2227 362/565 |
| 6,511,196 | B1 | 1/2003 | Hoy | |
| 6,923,549 | B2 | 8/2005 | Hoy | |
| 8,684,223 | B1 * | 4/2014 | Kalamaras | A47G 19/2227 220/592.17 |
| 8,919,981 | B2 | 12/2014 | Wang et al. | |
| 2003/0090892 | A1 * | 5/2003 | Su | A47G 19/2227 362/101 |
| 2003/0147234 | A1 * | 8/2003 | Harada | A47G 19/2227 362/84 |
| 2005/0207141 | A1 * | 9/2005 | Boesch | A47G 19/2227 362/101 |
| 2012/0176782 | A1 * | 7/2012 | VanderSchuit | F21V 14/08 362/184 |

(Continued)

FOREIGN PATENT DOCUMENTS

| | | | |
|---|---|---|---|
| KR | 200358175 Y1 * | 8/2004 | |
| WO | WO-2006117367 A2 * | 11/2006 | B65F 1/1463 |

*Primary Examiner* — Erin Kryukova

(74) *Attorney, Agent, or Firm* — Bacon & Thomas, PLLC

(57) ABSTRACT

A light-up beverage container or drinking vessel has a double wall construction made up of an inner container and an outer container, the inner container having a frustoconical, straight-walled shape and the outer container having a curved sidewall when viewed from the side. In order to achieve an attractive illuminated appearance, the curved outer sidewall of the preferred drinking vessel includes facets or prism structures formed in and extending around a circumference of the curved sidewall.

21 Claims, 3 Drawing Sheets

(56) References Cited

U.S. PATENT DOCUMENTS

| | | | | |
|---|---|---|---|---|
| 2014/0240962 | A1* | 8/2014 | Wang | A47G 23/02<br>362/101 |
| 2014/0353309 | A1* | 12/2014 | Albers | B65D 11/02<br>220/4.07 |
| 2016/0270572 | A1* | 9/2016 | Karussi | A47G 19/2288 |
| 2018/0334296 | A1* | 11/2018 | Velmont | B65D 81/3205 |

* cited by examiner

ILLUMINATED BEVERAGE CONTAINER

BACKGROUND OF THE INVENTION

1. Field of the Invention

This invention relates to a light-up beverage container or drinking vessel with a curved sidewall.

The beverage container or drinking vessel of the invention may be shaped to resemble a wine glass, tumbler, carafe, cruet, or other beverage container, glass, or cup with a sidewall that curves when viewed in a front, side, or rear elevation or vertical cross-section.

2. Description of Related Art

Light-up drinking vessels are known from, for example, U.S. Pat. Nos. 6,511,196 and 6,923,549, which disclose double walled cups or glasses having a double-walled construction in which light transmitted through a cavity between the inner and outer walls is refracted out through the outer wall of the drinking vessel when the light encounters a nonconformity on the inner wall. The light originates from LEDs positioned below the cavity, the nonconformity taking the form of a design or logo etched into an outer wall of the inner container.

U.S. Pat. No. 8,919,981, which is incorporated herein by reference, discloses improvements to the light-up cup arrangements shown in U.S. Pat. Nos. 6,511,196 and 6,923,549. For example, in the arrangement disclosed in U.S. Pat. No. 8,919,981, arched convex strips are formed on an interior surface of a vertical wall of the inner container, and light-splitting facets or prism shapes are formed at the bottom of the inner container, thereby causing multiple light refractions, and consequently a twinkling effect with dazzling variations. The light to be refracted is supplied from multiple LEDs positioned around a periphery of a base, below the bottom of the inner container. In addition, the outer container may be provided with printed designs to create further visual effects and enhance the aesthetic appeal of the cup when it is not illuminated.

The known light-up beverage containers or drinking vessels all share the characteristic of having a cylindrical or frustoconical outer sidewall, i.e., an outer cylindrical or frustoconical wall that is linear when viewed horizontally from the side, front, or rear, so that the inner and outer walls of the containers or drinking vessels can be configured to be substantially parallel when assembled together, and therefore refract the light in a way that enables uniform light emission for an aesthetically pleasing effect.

The effects achieved by the conventional light-up beverage containers have so far not been applied to beverage containers or drinking vessels having curved sidewalls, since it difficult to achieve uniform refraction of light onto a curved sidewall in order to achieve an aesthetically pleasing illumination effect. As a result, the variety of different beverage containers or drinking vessel shapes that may be illuminated is limited, and does not extend to wine glasses, carafes, and other vessels or containers with a more artistic curved shape.

SUMMARY OF THE INVENTION

It is accordingly a first objective of the invention to provide a light-up beverage containers or drinking vessels in which eye-catching light effects can be achieved despite the outer wall of the containers or vessels being curved.

It is a second objective of the invention to provide a light-up beverage containers or drinking vessels with curved sidewalls that is simple to manufacture and that has an attractive appearance when not illuminated as well as when illuminated.

These objections are achieved, in accordance with principles of a preferred embodiment of the invention, by a light-up beverage container or drinking vessel having a double wall construction made up of an inner container and an outer container, the inner container having a frustoconical, straight-walled shape and the outer container having a curved sidewall. The inner container may be similar in construction to the inner container of the illuminated drinking cup disclosed in U.S. Pat. No. 8,919,981, which includes a plurality of arched convex strips in a side wall of the inner container and diamond facets cut into a bottom of the container. The outer container of the preferred or exemplary illuminated drinking vessel, unlike that of U.S. Pat. No. 8,919,981, has a curved shape when viewed from the side. In order to achieve an attractive illuminated appearance, the curved outer sidewall of the preferred drinking vessel further includes diamond-cut facets or prism structures cut into the curved sidewall. The facets or prism structures give the appearance of expensive cut crystal and at the same time refracts light directed to the outer container from the arched convex strips of the inner container, thereby providing a twinkling light effect that extends around the cup and across the width of the band defined by the facets.

The outer container or shell may have a two part construction to facilitate manufacture and assembly. In addition, the curved-wall beverage container or vessel of the illustrated embodiment may also include a base structure integral with or fixed to the outer container for housing a circuit board on which are provided LED control circuitry, at least one button cell battery, and a push button. The LEDs are positioned around a periphery of the circuit board such that light from the LEDs is transmitted through the diamond facets at the base of the inner container and also into the space between the inner and outer containers.

In an exemplary embodiment of the invention, the outer container or shell is divided into an upper half and a lower half, joined by a zigzag interface having stepped inner and outer mating surfaces that facilitate alignment of the upper and lower halves and cause the outer container or shell to appear to be a single piece after joining the upper half to the lower half.

In the exemplary embodiment of the invention, the beverage container is in the form of a stemless glass or tumbler that includes a lid with a spout and stopper, enabling the container to serve as a carafe or pitcher. While the overall appearance is that of a wine glass or carafe, it is will be appreciated that the container of the invention may be used for any beverage, including non-alcoholic beverages as well as wine. The lid and stopper structure are exemplary only and may be eliminated or replaced by, for example, a lid with an opening for a straw.

DETAILED DESCRIPTION OF THE PREFERRED EMBODIMENTS

Figures 1, 2, 3:
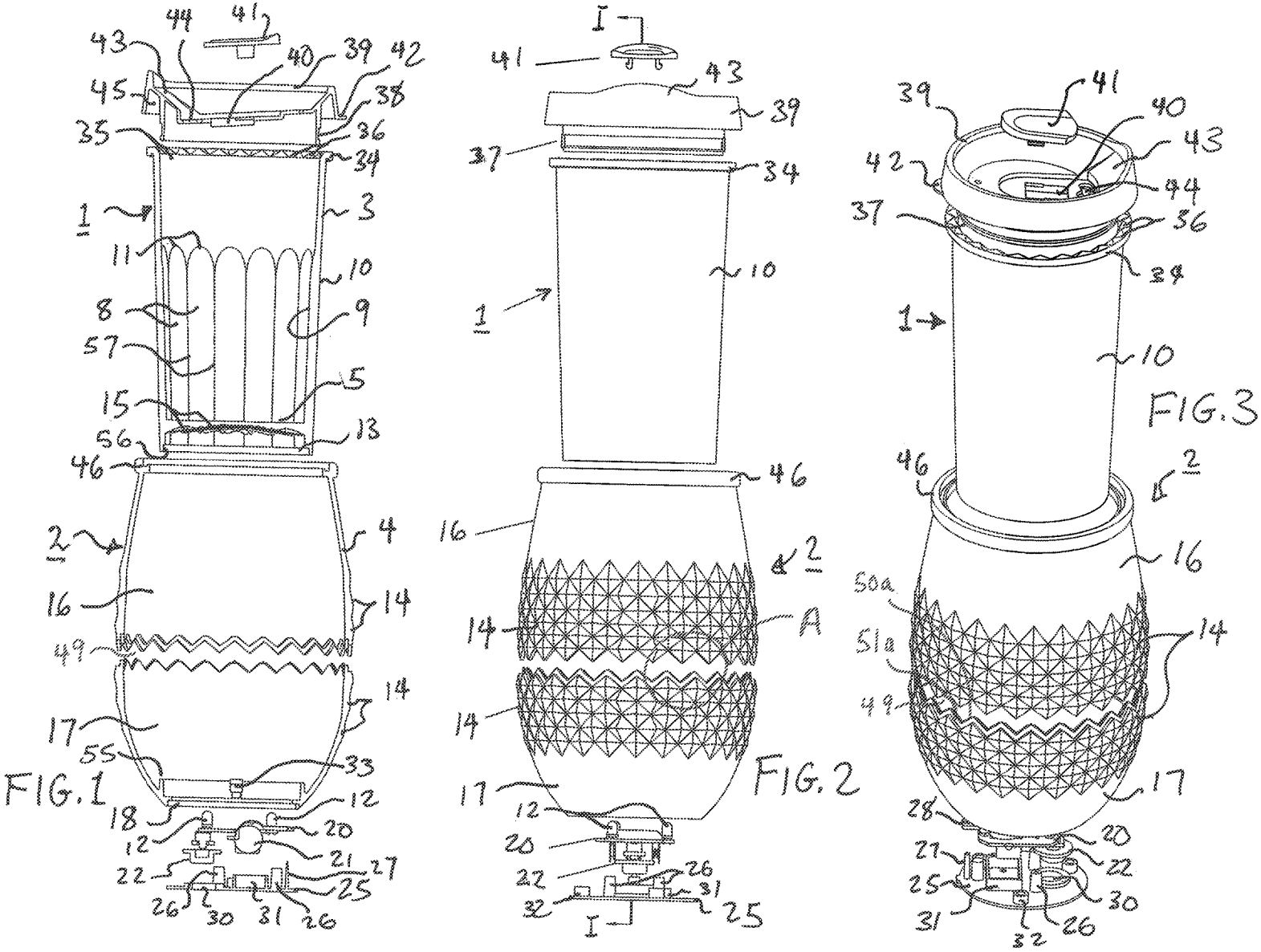
FIG. 1 is a cross-sectional side view, taken along line I-I in FIG. 2, of disassembled parts of an illuminated beverage container constructed in accordance with the principles of an exemplary embodiment of the invention.
FIG. 2 is a non-cross-sectional side view of the disassembled beverage container of FIG. 1.
FIG. 3 is an isometric view of the disassembled beverage container of FIGS. 1 and 2.

As shown in the respective exploded views of FIGS. 1-3, the illuminated or light-up beverage container or drinking vessel of a preferred embodiment of the invention includes an inner container 1 and an outer container 2. The inner container 1 has a frustoconical or cylindrical shape with a straight sidewall 3 when viewed from the side, front, or rear, i.e., in a horizontal direction. The outer container 2 has a flat bottom and a curved sidewall 4 when viewed from the side, front, or rear. The inner container 1 is inserted into the outer container 2 and includes a lower collar 55 that fits over cylindrical structure 56 projecting upwardly from a bottom of the outer container 2 to center the lower end of the inner container 1 with respect to the outer container 2. A rim 46 on the outer container 2 fits around a lip or rim 34 to center the upper end of the inner container, and to conceal the inner container 1 when a lid 39 is inserted into an upper opening 35 at the top of the inner container, as described in more detail below.

As illustrated in FIG. 1, the inner container 1 includes first refracting structures in the form of a plurality of arched convex strips 8 that extend upwardly from a bottom surface 5 of the main beverage-containing interior chamber of the inner container 1, and that are distributed around a circumference of the interior surface of the upwardly-extending sidewall of the inner container. As illustrated, the convex strips 8 have linear side edges 57, extend past a halfway point along a vertical axis of the container, and terminate in arched upper segments 11. The convexity of the strips 8 is with respect to the interior surface 9 of the container, so that the surfaces of the strips 8 extend towards the center of the container and inwardly from the interior surface when viewed from above or below, and a thickness of the container sidewall is greater in the area of an arched strips 8 than it is between or above the arched strips. The arched strips 8 do not, in the illustrated embodiment, extend to the cylindrical or frustoconical exterior side surface 10 of the inner container 1.

The effect of the convex strips 8 is to magnify, brighten, diffuse, and refract light traveling upwardly from LEDs 12 positioned below a lower end 13 of the inner container, so that the light from the LEDs is refracted to light refracting structures 14 in the curved sidewall of the outer container 2, which are provided to further brighten and diffuse light exiting the outer container 2 as described in more detail below.

In addition to the vertically-extending convex strips 8, a space between the interior bottom surface 5 and the lower end 13 of the inner container 1 may be provided with facets or prism structures 15 that present numerous inclined planes of different angles, causing light incident on them from the LEDs 12 to radiate outwardly in a dazzling visual effect.

Either or both of the convex strips 8 and facets or prism structures 15 at the lower end of the inner container 1 may be similar or identical to those disclosed in U.S. Pat. No. 8,919,981, which is commonly assigned and incorporated herein by reference. However, it will be appreciated that the length, widths, and exact shape of the upwardly-extending convex strips 8 and/or inner container facet or prism structures 15 may be varied without departing from the scope of the invention. For example, facets or prism structures 15 may be diamond-cut, pyramidal, or have any other shape that creates a prism or light splitting effect, and furthermore may take the form of a continuous structure or discrete, spaced apart prism structures.

The outer container 2, which has a curved sidewall 4, also includes and facets or prism structures 14, which are arranged circumferentially around the outside surface of the outer container 2. Structures 14 brightens and further diffuse light refracted by the refraction structures 8 and 15 on the inner container 1, thereby making it possible to achieve an aesthetically pleasing illumination effect while concealing the double wall construction of the beverage container or drinking vessel so that it resembles, when viewed from the outside a conventional single wall beverage container or drinking vessel. As with the refracting structures of the inner container, facets or prism structures 14 may have a variety of different shapes, including but not limited to diamond-cut or pyramidal shapes, and furthermore may be contiguous or discrete spaced-apart structures. To enhance the illusion of a single-walled drinking glass, the outer container may be made of a colored or tinted translucent plastic material.

Faces or prism structures 14 not only provide an enhanced illumination effect, but also enhance the appearance of the beverage container or drinking vessel when it is not illuminated. For example, the facets may be configured to simulate those of fine crystal wine glasses, even though the actual material of the container or vessel can be a relatively inexpensive molded plastic rather than cut crystal or glass. On the other hand, the principles of the invention may be applied to materials other than plastic, including glass or crystal.

Figure 4:
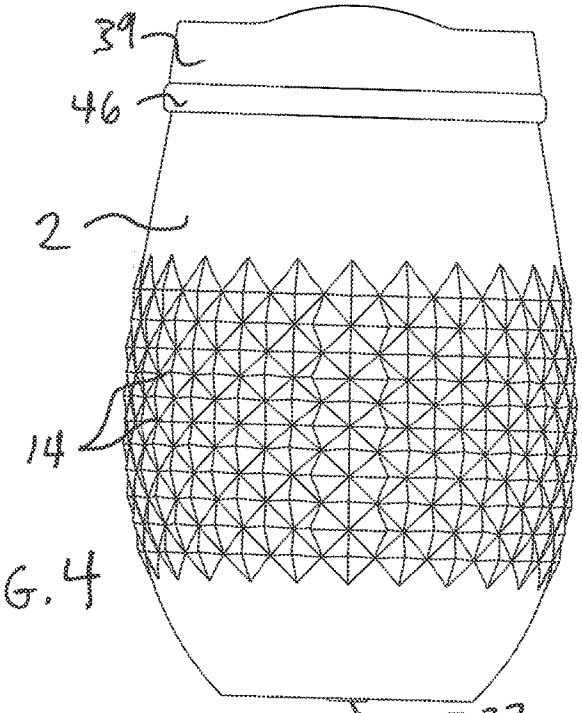
FIG. 4 is a side view of the assembled beverage container of FIGS. 1-3.
Figure 5:
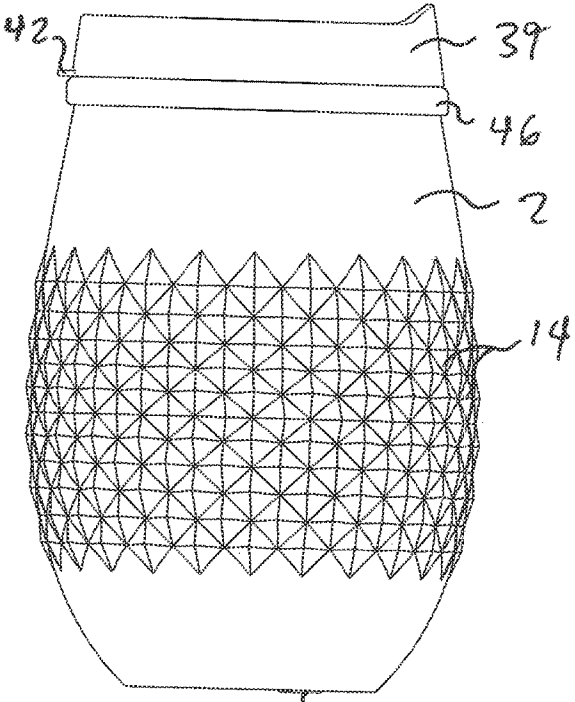
FIG. 5 is a front view of the assembled beverage container of FIGS. 1-3.
Figure 6:
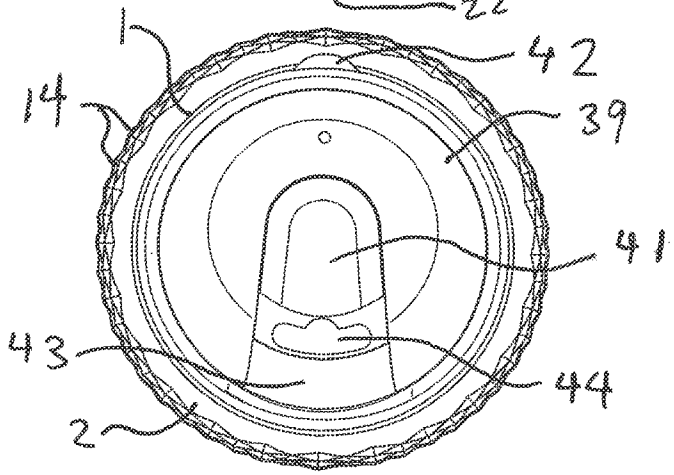
FIG. 6 is a top view of the assembled beverage container of FIGS. 1-3.

As illustrated in FIGS. 1-3, the outer container 2 may be constructed of upper and lower halves or shells 16 and 17 for ease of manufacture. The upper portion of the lower half 16 and the lower portion of the upper half 17 each may include circumferentially-extending bands of the facets or prism structures 14, so that the respective bands form a continuous faceted area when the halves are joined together, as shown in FIGS. 4 and 5.

Figure 7:
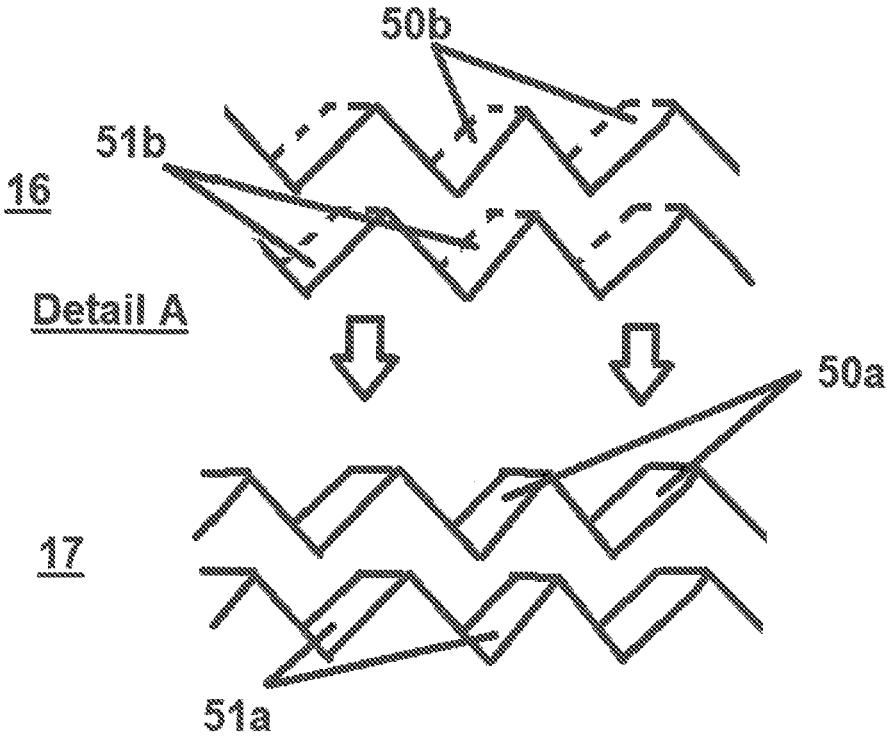
FIG. 7 is an enlarged view showing details of circled area "A" of FIG. 2.

As is best seen in FIG. 7, which is an enlarged view of section A of the interface 49 shown in FIG. 2, the interface 49 between the upper and lower shells 16 and 17 not only has a zigzag shape corresponding to angled edges of the prisms or facets 14, but also a stepped structure. The upper edge of the lower shell 17 includes inner surfaces 50*a* and vertically-offset inner surfaces 50*b*. The lower edge of the upper shell 16 includes inner surfaces 51*a* and vertically-offset outer surfaces 51*b*. The vertical offsets between the inner surfaces 50*a*,50*b* and outer surfaces 51*a*,51*b* result in the appearance of steps when the shells 16,17 are viewed in cross-section. As a result, when upper and lower shells 16 and 17 are jointed together, inner surfaces 50*a* and 50*b* abut and are joined to each other, and outer surfaces 51*a* and 51*b* abut and are joined to each other. The stepped shape of the interface, together with the zigzag shape, ensures that the upper and lower shells are aligned and appear to be a single piece when joined, facilitating assembly and enhancing the overall appearance of the beverage container or drinking vessel.

Construction of the outer container 2 of separate, joined-together upper and lower shells 16 and 17 has the additional advantage that the two shells may optionally be made of different materials, or materials having different colors. In a conventional one-piece vessel construction, dual color effects can only be achieved by painting or silk-screening.

The bottom of the exemplary outer container 2 illustrated in FIGS. 1-3 includes an opening 18 to receive a printed circuit board 20 having traces and circuitry (not shown) to which the LEDs 12 are electrically connected. The circuit board 20 supports an electrode structure and housing for receiving and electrically connecting a battery, such as a button cell 21, and a push button 22 for turning the LEDs on an off. The circuitry may include an integrated circuit or another control circuit or electronic component for causing the LEDs to flash, or to determination on-time or duration following pressing of the push button 22. It will be appreciated that numerous variations of the LED control circuitry, the power source and connections, and the activation button are possible, and that the electrical configuration of the circuit board 20 and corresponding circuitry form no part of the present invention.

Although only two LEDs 12 are clearly visible, it will be appreciated that any number of LEDs may be provided. If two or more LEDs 12 are provided, then the LEDs 12. may be arranged around a periphery of, or elsewhere on, the circuit board 20.

The circuit board 20 is mounted to a bottom lid 25 or closure for the outer container. By way of example and not limitation, the circuit board 20 may be supported by posts 26 and aligned by a pin 27 extending upwardly from the lid 25 through a pin hole 28 in a tab extending from the circuit board, such that the push button 22 and battery support/electrode structure are respectively aligned with a hole 30 in the bottom lid 25 and a battery access or support compartment 31, also in the lid 25. Also by way of example and not limitation, the bottom lid 25 may include cylindrical posts 33 through which screws (now shown) may be inserted to secure the bottom lid 25 to the outer container 2 via internally threaded posts 33.

It will be appreciated that the manner in which the circuit board is supported and/or aligned, and the manner in which the bottom lid 25 is secured to the outer container 2, may be varied or modified in numerous ways without departing from the scope of the invention.

At the top of the inner container 1 is an optional rim 34 surrounding the inner container upper opening 35. The illustrated faceted structures 36 are provided to engage a silica gel sealing ring 37 (shown in FIGS. 2 and 3 but not FIG. 1), which is fitted into a groove 38 extending around a neck of an upper lid 39 to tightly hold the upper lid 39 in place and prevent spillage.

In the illustrated embodiment lid 39 includes an opening 40 for dispensing the beverage or to permit entry of air for decanting, and which may be sealed by a snap-in closure 41. A tab 42 may be provided to facilitate removal of the lid, and the lid may be asymmetrically shaped to form a spout 43 positioned adjacent an opening 44 through which contents of the inner container may be poured. The periphery of the lid 39 forms a downwardly facing groove 45 that fits over the rim 34 and extends to rim 46 extending around a top of the outer container 2 to conceal the inner container 1.

As with the base/electronics structure discussed above, the configuration of the lid may be varied without departing from the scope of the invention. In addition, it will be appreciated that the lid 39 may be dispensed with entirely and that the upper end of the inner container may be left open.

Although a number of embodiments of the invention have been described in detail in connection with the accompanying drawings, it will be appreciated that modifications of the illustrated embodiments may be made without departing from the scope of the invention. For example, the external shape of the outer container is not limited to the illustrated form, but rather may constructed to have any beverage container or drinking vessel shape, including shapes of wine, champagne, cognac, and other glasses, as well as carafes, cruets, pitchers, decanters and so forth, with the shapes and locations of the facet structures 14 being varied accordingly both to provide desired illumination effects and to enhance the appearance of the beverage container or drinking vessel. In addition, the arrangement and colors of the LEDs, and the functions or arrangement of the control circuitry, the power supply, and other electrical components may be varied without departing from the scope of the invention. Any such modifications may be considered to be within the scope of the invention, which is to be defined solely by the appended claims.

What is claimed is:

1. A light-up beverage container, comprising:

an outer container including an interior space configured to hold a beverage;

an inner container positioned within the outer container; and at least one LED positioned at a lower end of the outer container, wherein:

the inner container includes a liquid holding interior space and a plurality of refracting structures for creating predetermined light effects and for directing light from the at least one LED towards the outer container, the outer container has a curved sidewall and a plurality of facet structures extending around the curved sidewall, and the refracting structures are positioned to refract light traveling upwardly through the inner container from the at least one LED towards the refracting structures, wherein the light refracted by the refracting structures is directed towards the facet structures extending around the curved sidewall of the outer container, in order to generate uniform lighting effects around the circumference of the outer container, wherein a curvature of the sidewall is apparent when viewed in a front, side, or rear elevation, or in a vertical cross-section, of the outer container.

2. A light-up beverage container as claimed in claim 1, wherein the refracting structures of the inner container include vertically-extending convex structures that extend inwardly from a cylindrical or frustoconical sidewall of the inner container.

3. A light-up beverage container as claimed in claim 2, wherein the refracting structures further include a plurality of facets or prism structures situated between a bottom of the liquid holding interior space and the at least one LED.

4. A light-up beverage container as claimed in claim 3, wherein the at least one LED includes a plurality of LEDs positioned below the inner container.

5. A light-up beverage container as claimed in claim 1, wherein the refracting structures of the inner container include a plurality of facets or prism structures situated between a bottom of the liquid holding interior space and the at least one LED.

6. A light-up beverage container as claimed in claim 1, wherein the outer container includes an upper part and a lower part, each including the plurality of said facet structures extending around an outer circumference of each of the upper part and the lower part to form a single band of facet structures when the upper part is joined to the lower part.

7. A light-up beverage container as claimed in claim 6, wherein the upper part and the lower part are made of materials having different colors.

8. A light-up beverage container as claimed in claim 1, wherein the at least one LED is mounted on a circuit board that fits through an opening at the lower end of the outer container.

9. A light-up beverage container as claimed in claim 8, wherein the circuit board is mounted to a bottom lid fixed to a bottom of the outer container.

10. A light-up beverage container as claimed in claim 9, wherein the circuit board supports and electrically connects a push button that extends through an opening in the bottom lid to enable a user to turn the at least one LED on and off.

11. A light-up beverage container as claimed in claim 8, wherein the circuit board supports a battery and electrically connects the battery to the at least one LED.

12. A light-up beverage container as claimed in claim 8, wherein the at least one LED includes a plurality of LEDs positioned below the inner container.

13. A light-up beverage container as claimed in claim 1, further comprising an upper lid having a neck that fits into an opening at a top of the inner container.

14. A light-up beverage container as claimed in claim 13, wherein an elastomeric seal extends around the neck.

15. A light-up beverage container as claimed in claim 13, wherein the upper lid includes a pouring opening and a spout through which a beverage may be poured from the inner container.

16. A light-up beverage container as claimed in claim 13, wherein the upper lid includes a generally centrally located opening and a cover that snaps into the generally centrally located opening to prevent ingress of dust.

17. A light-up beverage container, comprising:

an outer container including an interior space configured to hold a beverage;

an inner container positioned within the outer container; and at least one LED positioned at a lower end of the outer container, wherein:

the inner container includes a liquid holding interior space and a plurality of refracting structures for creating predetermined light effects and for directing light from the at least one LED towards the outer container, the outer container has a curved sidewall and a plurality of facet structures extending around the curved sidewall, and the refracting structures are positioned to refract light traveling upwardly from the at least one LED towards the facet structures extending around the curved sidewall of the outer container, in order to generate uniform lighting effects around the circumference of the outer container, wherein a curvature of the sidewall is apparent when viewed in a front, side, or rear elevation, or in a vertical cross-section, of the outer container wherein the outer container includes an upper part and a lower part, each including the plurality of said facet structures extending around an outer circumference of each of the upper part and the lower part to form a single band of facet structures when the upper part is joined to the lower part, wherein an interface between the upper part and the lower part has a zigzag shape, and includes respective lower and upper surfaces that are step-shaped when viewed in cross-section to facilitate alignment of the upper and lower parts and enhance the appearance of the outer container as a single piece.

18. A light-up beverage container, comprising:

an outer container including an interior space configured to hold a beverage;

an inner container positioned within the outer container; and an LED module that includes at least one LED and that is fixed to a lower end of the outer container, wherein:

the inner container includes a plurality of refracting structures for creating predetermined light effects and for directing light from the at least one LED towards the outer container, the inner container and the outer container are made of molded plastic, the outer container includes first and second discrete pieces, the first discrete piece being an upper part and the second discrete piece being a lower part, the upper part and the lower part of the outer container together form a curved sidewall, the refracting structures are positioned to refract light traveling upwardly from the at least one LED towards the curved sidewall of the outer container, in order to generate uniform lighting effects around the circumference of the outer container, a curvature of the sidewall is apparent when viewed in a front, side, or rear elevation, or in a vertical cross-section, of the outer container, a diameter of an upper end of the outer container is less than a diameter of a section of the outer container that is between the upper end of the outer container and the lower end to which the LED module is fixed.

19. A light-up beverage container as claimed in claim 18, wherein an interface between the upper part and the lower part has a zigzag shape, and includes respective lower and upper surfaces that are step-shaped when viewed in cross-section to facilitate alignment of the upper and lower parts and enhance the appearance of the outer container as a single piece.

20. A light-up beverage container as claimed in claim 18, wherein the upper part and the lower part are made of materials having different colors.

21. A light-up beverage container as claimed in claim 18, wherein the lower end of the outer container includes molded securing structures for receiving fasteners that removably fix the LED module to the lower end of the outer container.

* * * * *